United States Patent [19]

Hurst

[11] 4,079,760

[45] Mar. 21, 1978

[54] BAFFLE FOR AUTOMATIC OUTAGE

[75] Inventor: Doug Hurst, Montreal West, Canada

[73] Assignee: General American Transportation Corporation, Chicago, Ill.

[21] Appl. No.: 755,157

[22] Filed: Dec. 29, 1976

[51] Int. Cl.[2] ..... B65B 31/00; F17D 1/00

[52] U.S. Cl. ..... 141/35; 141/98; 137/57 S

[58] Field of Search ..... 141/3 S, 1, 2, 36, 67, 141/98, 113, 231–233, 286; 137/1, 57 S; 105/358, 360

[56] References Cited

U.S. PATENT DOCUMENTS 4,002,192 1/1977 Mowatt-Larssen ..... 141/3 S 4,008,739 2/1977 Hurst et al. ..... 141/3 S

*Primary Examiner*—Houston S. Bell

*Attorney, Agent, or Firm*—Vogel, Dithmar, Stotland, Stratman & Levy

[57] ABSTRACT

A railway train comprised of interconnected tank cars, each provided with two lading conduits coupled to and in fluid communication with the tank car. A baffle is positioned in the tank car intermediate the lading conduits to provide an automatic outage for the tank car. Liquid lading introduced into the tank car through one of the lading conduits fills the tank car thereby trapping gas vapor resulting in overflow of the liquid lading into the next tank car to fill the tank train seriatim.

11 Claims, 10 Drawing Figures

PUMPING

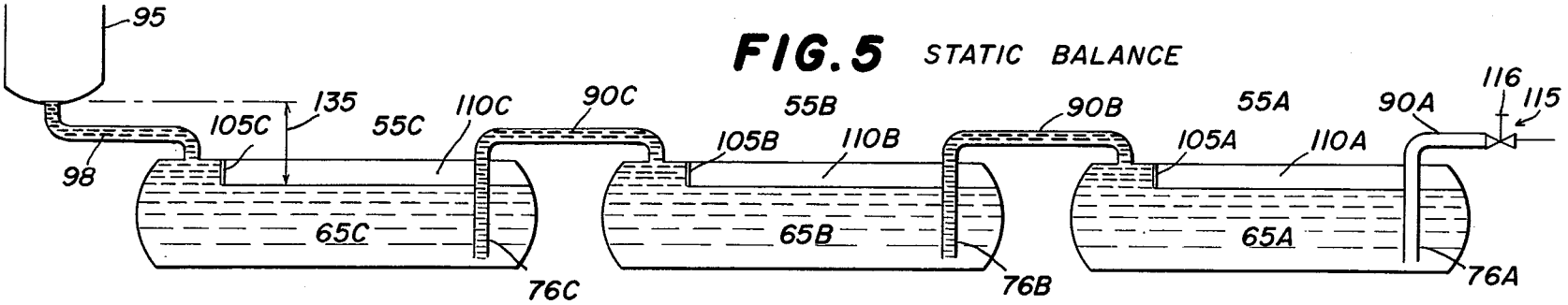
FIG. 5 STATIC BALANCE
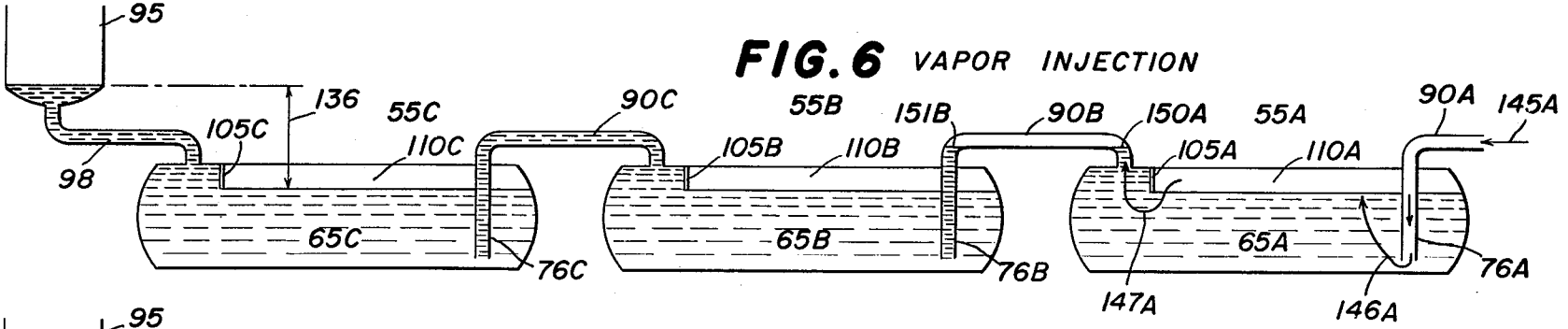
FIG. 6 VAPOR INJECTION
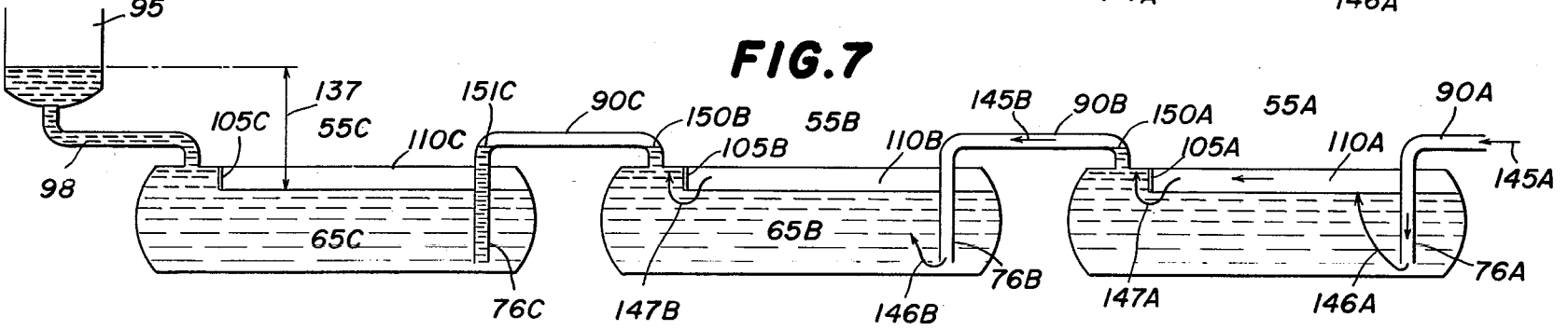
FIG. 7

BAFFLE FOR AUTOMATIC OUTAGE

CROSS-REFERENCE TO RELATED APPLICATION

This application is an improvement of U.S. Pat. No. 3,897,807, issued Aug. 5, 1975, for MANIFOLDED TANK CARS FOR UNIT TRAIN SERVICE.

BACKGROUND OF THE INVENTION

The present invention relates to railway tank cars, and, in particular, to manifolded tank cars in which the outage of each tank car is determined by a baffle positioned therein, thereby to accommodate loading or unloading of the entire group of interconnected tank cars without movement thereof from a single point.

The concept of providing fluid communication among a series of interconnected railway tank cars is disclosed in the prior art, but previous systems have failed to provide a simplified method and apparatus for determining the outage of each tank car. The present invention permits consecutive loading of a train of tank cars from either end thereof and is also adaptable to be unloaded from either end thereof.

SUMMARY OF THE INVENTION

The present invention provides a railway tank car for unit train service which determines the outage independently of the inlet and the outlet lading conduits and which permits the train or individual tank car to be loaded or unloaded from either end thereof.

It is an important object of the present invention to provide a tank car of the character described in which the outage is determined by a baffle in the tank car.

Another object of the present invention is to provide a railway tank car for interconnection in fluid communication with associated tank cars by flexible connecting conduits for accommodating consecutive loading, unloading and transportation of expandable ladings, the tank car comprising a wheeled chassis structure providing with chassis coupling means for coupling to the chassis of associated cars, a tank mounted on the chassis structure, lading conduit means mounted on the top of the tank and having two outer ends extending outwardly from the tanks adjacent to the top thereof, an eduction conduit having an outer end in fluid communication with the lading conduit means and having an inner end in fluid communication with the interior of the tank, the inner end of the eduction conduit being positioned near the bottom of the tank to facilitate the emptying of the tank through the eduction conduit, a vent conduit having an outer end in fluid communication with the lading conduit means and having an inner end in fluid communication with the interior of the tank, and a baffle positioned between the lading conduit means extending a predetermined distance into the tank and forming a fluid tight seal therewith, filling of the tank through the eduction conduit with lading to a level above the end of the baffle causing compression of gas trapped above the lading to a pressure at which occur out flow of lading through the vent conduit at the same rate as the in flow of lading through the eduction conduit thereby to provide in the tank above the lading a free vapor space, and conduit coupling means on each of the lading conduit means for coupling to an adjacent end of an associated flexible connecting conduit to place the tank in fluid communication with the tanks of adjacent-like tank cars, whereby the tank may be connected by associated flexible connecting conduits to associated like tanks in a series through which expandable liquid lading may flow to accommodate consecutive loading to a predetermined level, transporting thereof while automatically providing a free vapor space at the top of the tank above the liquid lading, and substantially complete unloading thereof through the eduction conduit.

A further object of the present invention is to provide a railway tank car of the type set forth in which there are provided two eduction conduits each having an outer end in fluid communication with the lading conduit means and having an inner end in fluid communication with the interior of the tank and two vent conduits each having an outer end in fluid communication with the lading conduit means and having an inner end in fluid communication with the interior of the tank and a plurality of valves for interrupting communication between the vent conduits and the lading conduit means and between the eduction conduits and the lading conduit means.

A final object of the present invention is to provide a railway tank car train incorporating the tank cars previously set forth.

These and other objects of the present invention together with further objects and advantages thereof will best be understood by reference to the following specification, taken in connection with the accompanying drawings.

BRIEF DESCRIPTION OF THE DRAWINGS

FIG. 5 is a schematic illustration showing the tank car in a static condition in which the interconnecting conduits are filled with liquid lading;

FIGS. 6 through 8 are schematic illustrations showing the seriatim emptying of liquid lading from the interconnecting conduits;

DESCRIPTION OF THE PREFERRED EMBODIMENT

Figures 1, 2, 3, 4:
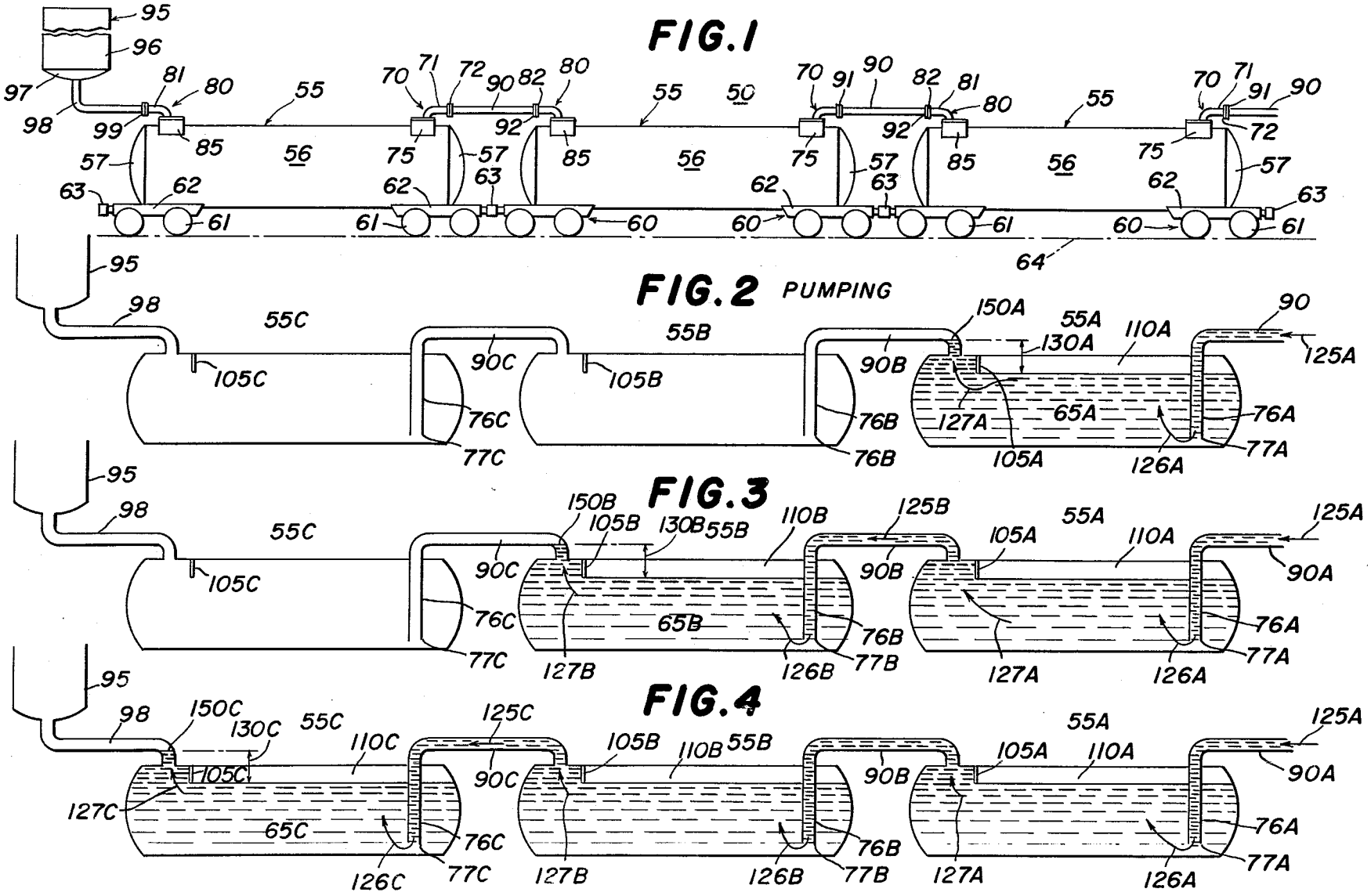
FIG. 1 is an elevational view of a railway train showing the individual tank cars in fluid communication one with the other.
FIGS. 2, 3 and 4 are schematic illustrations showing the seriatim filling of tank cars with liquid lading.

Referring now to the drawings and, in particular, to FIG. 1, there is disclosed a train 50 of individual tank cars 55, each comprised of a cylindrical body shell 56 closed at either end thereof by domed shaped ends 57. Each of the tank cars 55 is provided with two trucks 60, each of which carries four railway wheels 61 adapted to ride on standard railway tracks 64. Each of the trucks 60 is connected to a draft sill 62 and also carries a coupling mechanism 63 for coupling adjacent tank cars 55. It is seen, therefore, that each tank car 55 defines a closed container for storing or transporting liquid lading 65 therein.

Each of the tank cars 55 is provided with a lading conduit 70 adjacent one end thereof which includes a short horizontal pipe section 71 extending parallel to the longitudinal axis of the tank car and spaced from the top thereof and termination inboard of the adjacent dome end 57. The lading conduit 70, and particularly the short horizontal section 71, terminates in a mounting flange 72. The lading conduit 70 further includes a vertically extending elongated eduction pipe section 76 terminating at an end 77 positioned near the bottom of the tank car 55. The lading conduit 70 enters the tank car 55 through a housing 75 for a butterfly valve (not shown) which can either establish fluid communication between the inside of the tank car 55 and the pipe section 71 or interrupt fluid communication between the inside of the tank car and the pipe section 71.

Each of the tank cars 55 is further provided with a lading conduit 80 positioned near the end of the tank car opposite to the lading conduit 70. The lading conduit 80 includes a short horizontally extending pipe section 81 which is parallel to the longitudinal axis of the tank car 55 and is spaced from the top thereof. The horizontal pipe section 81 terminates in a mounting flange 82 which is located inboard of the adjacent dome end 57. The lading conduit 80 enters the tank car 55 via a short vertical vent pipe section through a valve housing 85 for a butterfly valve (not shown) for either establishing communication between the inside of the tank car and the short pipe section 81 or interrupting communication between the pipe section 81 and the inside of the tank car 55, it being noted that the lading conduit 80 terminates at the top of the tank car 55 and is substantially flush therewith.

Flexible connecting conduits 90 with mounting flanges 91 and 92 on the respective ends thereof mate with corresponding ones of the mounting flanges 72 and 82. The flexible connecting conduits 90 interconnect adjacent tank cars 55 and provide fluid communication therebetween if the appropriate butterfly valves (not shown) are open.

A storage tank 95 has a cylindrical body 96 terminating in a conical end 97 from which depends a connecting pipe 98 having a mounting flange 99 at the terminal end thereof. The mounting flange 99 is constructed and arranged to connect with the mounting flange 82 on the endmost tank car 55, thereby to establish fluid communication between the storage tank 95 and the tank cars 55 in the train 50.

Each of the tank cars 55 is provided with a baffle 105 positioned intermediate the lading conduits 70 and 80, which baffle is secured such as by welding, to the respective tank car in such a manner as to provide a fluid tight connection between the baffle and the tank car shell 56. The baffle 105 extends a predetermined distance downwardly into the tank car 55 and, as will be described, provides a vapor space 110 when the tank car is filled with liquid lading 65. As the tank car 55 is filled with liquid lading 65 through the conduit 70, gas vapor is free to leave the tank car through the conduit 80. However, after the level of the lading 65 reaches the bottom of the baffle 105, the gas vapor between the tank car shell 56, the associated dome end 57, the baffle 105 and the top of the liquid lading 65 is trapped in the vapor space 110. The volume of the gas vapor trapped in the vapor space 110 will vary in response to changes in the pressure exerted on the liquid lading 65 in the tank car 55. As the pressure on the liquid lading 65 increases, the volume of the vapor space 110 will contract and conversely, as the pressure on the liquid lading is decreased, the volume of the gas vapor in the vapor space will increase.

In the discussions hereinafter relating to the conditions present in any one of the tank cars 55 during the pumping of liquid lading into the tank cars, during the static balance condition and during the vapor injection phase of the loading operation, the following definitions pertain:

$V_o$ = the volume of gas vapor trapped in the space defined by the baffle 105 and the tank shell 56 and the associated dome end 57 if a horizontal plane extended from the bottom edge of the baffle to the associated dome end.

$h$ = the level above the bottom edge of the baffle to which the liquid must be pumped, expressed in units of pressure.

$\Delta P$ = the pressure head necessary to cause the liquid to flow.

P = the gas pressure in the tank car.

$p$ = the pumping pressure.

Referring now to FIGS. 2 through 4, which show the seriatim filling of the tank cars 55A, 55B and 55C with liquid lading 65, it is seen that liquid lading is introduced through a valve 115 having a control 116 (see FIG. 5), the lading flow being represented by the arrow 125A. While the following description relates to three interconnected tank cars 55, it will be appreciated that any number of tank cars may be filled and the conditions set forth below relative to the three tank cars will pertain for a train 50 of any number of tank cars.

As the liquid lading 65A fills the tank car 55A, the gas vapor therein is initially at atmospheric pressure and flows out of the tank car as the vapor is displaced by the lading. When the liquid lading reaches the bottom edge of the baffle 105A, gas vapor is trapped in the vapor space 110A. As the liquid lading 65A continues to rise in the tank car 55A, pressure is exerted on the gas trapped in the vapor space 110A and when the liquid lading reaches the level 150A, as seen in FIG. 2, the pressure exerted on the gas in the vapor space 110A is such that the volume $$V_A = V_o \times (Patm/P_A),$$

where $$P_A = Patm + h\,(130A) + \Delta P_A.$$

Assuming that the last tank car 55C in the tank train 50 is vented to the atmosphere or otherwise provides for the transfer of gas vapor therefrom without substantial flow resistance, the pressure head necessary to cause liquid to flow from the tank car 55A to the tank car 55B will be determined by the level 150A in addition to the losses due to friction in the pipes interconnecting the source of liquid lading and the tank car 55B. As the liquid lading rises in the tank car 55B, the pumping pressure will continue to increase, until $P_B$ for the condition illustrated in FIG. 3 is as follows:

$$P_B = Patm + h\,(130B) + \Delta P_B,$$

and $$V_B = V_o \times (Patm/P_B)$$

The conditions in tank 55A are:

$$P_A = Patm + h + \Delta P_A + \Delta P_B$$

$$V_A = V_o \times (Patm/P_A)$$

Similarly, the conditions illustrated in FIG. 4 are:

$$P_C = Patm + h\,(130C) + \Delta P_C$$

$$V_C = V_o \times (Patm/P_C)$$

$$P_B = Patm + h\ (130B) + \Delta P_C + \Delta P_B$$

$$V_B = V_o \times (Patm/P_B)$$

$$P_A = Patm + h\ (130B) + \Delta P_A$$

$$V_a = V_o \times (Patm/P_A)$$

Accordingly, at the conditions of FIG. 4, $$V_C > V_B > V_A$$

which is as expected.

FIG. 5 represents a static condition after a gas, such as air, has been introduced through pipe 90A to force the lading 65 out of the pipe, resulting in an increase in the head (*h*) in the pipe 98, as denoted by the numeral "135." At this time the conditions in tank 55A are:

$$P_A = Patm + h\ (135),$$

assuming no frictional losses, $$V_A = V_o \times (Patm/P_A)$$

When gas injection is continued, the gas flow path being denoted by the arrows 145A, 146A and 147A, the gas flows first to the vapor space 110A and enlarges the volume $V_A$ to $V_o$ after which the gas spills under the baffle 105A and into the connecting pipe 90B, to clear the horizontal leg therein, as seen in FIG. 6. Continued gas injection produces the configuration of FIG. 7, where (*h*) is now denoted as 137 and the conditions are:

$$P_B = Patm + h$$

$$V_B = V_o \times (Patm/P_B)$$

In FIG. 7, the lading 65 is now cleared from the conduits 76A and 76B, while lading remains in (what would be 80A and 80B) the connecting pipes at the levels 150A and 150B.

Figure 8:
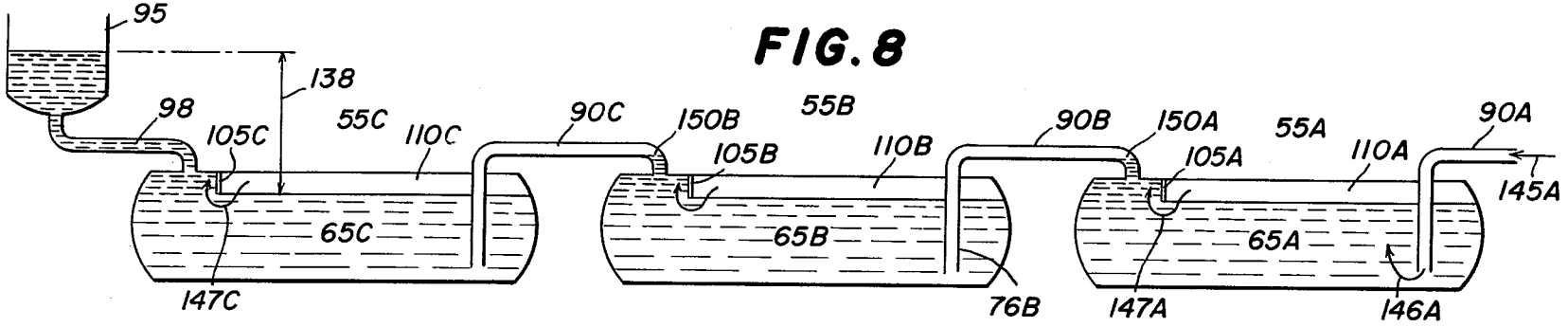

Continued gas injection results in the conditions shown in FIG. 8, wherein:

$$P_C = Patm + h\ (138)$$

$$V_C = V_o \times (Patm/P_C)$$

The before mentioned relationship of $V_C > V_B > V_A$ still applies. During the transfer from the conditions of FIG. 5 to those of FIG. 8, the gas flow path has been reperesented by the arrows 145, 146 and 147 for each of the three tank cars 55A, 55B and 55C.

Figure 9:
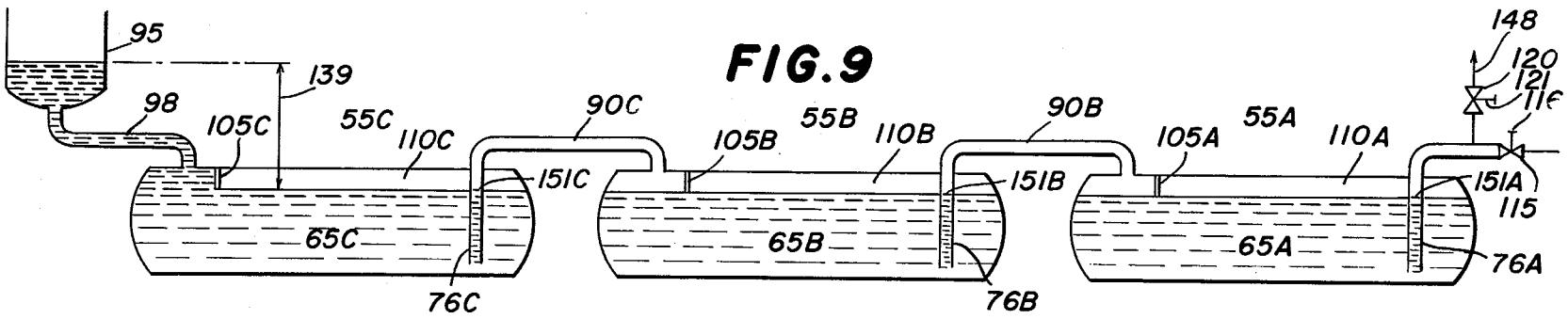
FIG. 9 is a schematic illustration showing the condition of the individual tank cars during transport.

Since it is desirable to have the connecting conduits 90 empty during the transit of the train 50, gas vapor is bled from the system by means of the relief valve 120 and control 121 therefor. As seen in FIG. 9, gas vapor is allowed to escape from the tank car 55A through the valve 120 as illustrated by the arrow 148. Gas is bled from the train 50 until the conditions shown in FIG. 9 are obtained, at which time the liquid lading level in tank 55A is as shown with liquid lading 65 being present in the conduit 76A to a level 151A, and with liquid lading 65B in the tank car 55B, in the conduit 76B to the level 151B and with the lading 65C present in the tank car 55C in the conduit 76C to the level 151C. These conditions result in the liquid level in the storage tank 95 dropping since release of the gas vapor from the system permits liquid lading to flow downwardly from the storage tank 95 into the tank cars 55. The head (*h*) is now shown by the reference numeral 139 and is less than the head 138. As seen, liquid lading 65 now is present in each of the eduction conduits 76A, 76B and 76C, while liquid lading has dropped from the lading conduits 80A, 80B and 80C to provide a liquid lading level substantially as shown in FIG. 9. The conditions in FIG. 9 are as follows:

$$P_C = Patm + h\ (139)$$

$$V_C = V_o \times (Patm/P_C)$$

$$P_B = Patm + h\ (139)$$

$$V_B = V_o \times (Patm/P_B) = V_o \times (Patm/P_C) = V_C$$

$$P_A = Patm + h\ (139)$$

$$V_A = V_B = V_C = V_o \times (Patm/P_A)$$

At these conditions the tank car 55C is sealed from the storage vessel 95 and the train 50 is in condition for transportation to the unloading point.

Unloading of the train 50 is accomplished in substantially the reverse manner of the loading, wherein a gas vapor is pumped into the vent conduit 80 of the endmost car of the train 50 and the tank cars 55 empty seriatim as pressure is built up in each tank car sufficient to force the liquid lading up through the eduction conduit 76 and out through the lading conduit 70 into the next adjacent tank car 55.

It will be seen, therefore, that there has been provided a tank car 55 for unit train service in which the automatic outage is determined by the baffle 105 in cooperation with the conduits 70 and 80.

Figure 10:
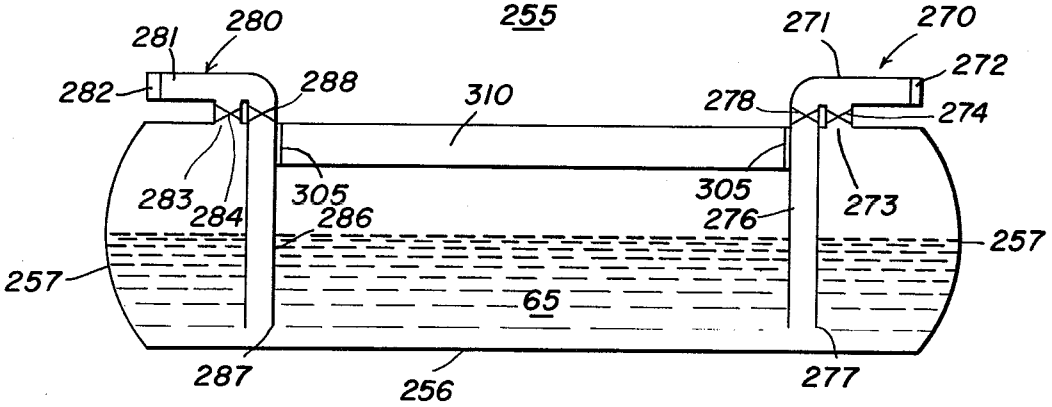
FIG. 10 is a side elevational view of a second embodiment of the present invention.

Referring now to FIG. 10, there is illustrated an alternative embodiment of the tank car 55 just described which permits filling and emptying of the tank car from either end thereof. The tank car 255 is similar in construction to the tank car 55 and includes a cylindrical body shell 256 closed at either end thereof by dome ends 257. Although not illustrated, the tank car 255 includes a standard truck structure and draft sills as is known in the art.

Each of the tank cars 255, which may be used in a train 50 to transport liquid lading 65, includes a lading conduit 270 having a horizontal pipe section 271 extending parallel to the longitudinal axis of the tank car 255, but spaced upwardly from the top of the tank car. The pipe section 271 ends in a mating flange 272 inboard of the associated dome end 257. The pipe section 271 is in fluid communication with the interior of the tank car 255 through a vent 273, a valve 274 being provided between the vent 273 and the pipe 271 to interrupt fluid communication therebetween. Similarly, the pipe 271 is in fluid communication with the interior of the tank car 255 through an eductor 276 which extends downwardly into the tank 255 and has a terminal end 277 situated near the bottom of the tank car, the vent 273 and the eductor 276 preferably sharing a common wall. A valve 278 is positioned in the eductor 276 to interrupt fluid communication between the pipe 271 and the interior of the tank car 255. For reasons hereinafter set forth, the vent 273 is preferably positioned outboard of the eductor 276.

At the other end of the tank car 255 there is provided a lading conduit 280. The lading conduit 280 is similar to the lading conduit 270 and includes a horizontal pipe section 281 extending parallel to the longitudinal axis of the tank car 255, but spaced upwardly from the top of the tank car. The pipe section 281 ends in a mating flange 282 inboard of the associated dome end 257. The pipe section 281 is in fluid communication with the interior of the tank car 255 through a vent 283, a valve 284 being provided between the vent 283 and the pipe 281 to interrupt fluid communication therebetween. Similarly, the pipe 281 is in fluid communication with the interior of the tank car 255 through an eductor 286 which extends downwardly into the tank 255 and has a terminal end 287 situated near the bottom of the tank car, the vent 283 and the eductor 286 preferably sharing a common wall. As with the conduit 270, the vent 283 is outboard of the eductor 286. A valve 288 is positioned in the eductor 286 to interrupt fluid communication between the pipe 281 and the interior of the tank car 255.

Two spaced-apart baffles 305 are positioned intermediate the conduits 270 and 280. Each of the baffles 305 is secured to the tank car 255 and, more particularly, to the shell 256 thereof and to the eductors 276 and 286, such as by welding, to provide a fluid tight connection between the baffle, the eductors and the tank car. The baffles 305 extend a predetermined distance downwardly into the tank car 255 and provide a vapor space 310 therebetween.

Operation of the tank car 255 is similar to the operation of the tank cars 55, previously described. Because of the nature of the lading conduits 270 and 280, it is apparent that lading can be introduced into the tank car 255 through either of the conduits by adjusting the associated valves, as hereinafter described. When lading is introduced into the tank car 255 through the conduit 270, the valve 278 is open and the valve 274 is closed. If the tank cars 255 are interconnected, then the conduit 280 must accommodate fluid transfer into the next adjacent tank car, when lading is introduced into the tank car through the conduit 270. In order for the conduit 280 to accommodate both vapor and fluid transfer to the next adjacent tank car 255, the valve 284 is open and the valve 288 is closed.

In the foregoing manner, lading introduced into the tank car 255 through the conduit 270 flows downwardly through the eductor 276 and outwardly from the terminal end 277 thereof into the tank car 255. Gas vapor exits through the vent 283 and the conduit 280 until the lading 65 reaches a level sufficient to pass through the conduit 280 into the next adjacent car, at which time gas vapor will have been trapped between the baffles 305 in the vapor space 310. The conditions which pertained to the tank cars 55 during the pumping and seriatim filling of the interconnected cars pertain to the tank cars 255.

Conversely, if fluid lading 65 is introduced into the tank car 255 through the conduit 280 then gas vapor as well as fluid lading exits the tank car through the conduit 270. To accommodate this flow path, valve 288 must be open, valve 284 closed, valve 274 open and valve 278 closed. This condition is simply the reverse of the previously described condition.

There are some differences in the operation of the tank car 255 and the tank car 55 and these principally occur during the injection of gas vapor into the tank car 255 to clear the interconnecting conduits to prepare a tank train of cars 255 for transit. Where the conduit 270 introduces lading 65 into the tank car 255 and the conduit 280 transfers lading out of the tank car into the next adjacent car, vapor injection is used to clear the eductor 276, in a manner similar to that shown in FIG. 5, for the tank car 55.

Further injection of vapor into the tank car 255 to replicate conditions illustrated in FIG. 6, do not result in clearing lading from the eductor 286 since the valve 288 is closed and lading 65 will remain in the eductor at the same level as the lading in the tank car 255. Continued vapor injection through the eductor 276 will clear the horizontal connecting conduit of lading as shown in FIG. 6. This result is obtained since the vapor has no place to go except into the vapor space 310 and thereafter into the conduit 280 through the vent 283 since the valve 274 is closed, thereby preventing vapor from forcing liquid lading out of the vent 273. As previously explained, continuing vapor injection will clear liquid lading 65 from each of the eductors 276 in each of the tank cars 255 and from the horizontal connecting conduits between adjacent tank cars until the conditions illustrated in FIG. 8 pertain. Vapor bleed from the system will thereafter produce conditions illustrated in FIG. 9, with the exception that the eductors 286, as well as the eductors 276, will be filled with liquid lading.

Removal of liquid lading 65 from the tank car 255 is accomplished in substantially the same manner as previously described for the tank car 55. Gas vapor is injected through one of the conduits and, more particularly, through the associated vent to force liquid lading 65 out of the other conduit and, more particularly, the associated eductor. Specifically, if gas vapor is introduced through the conduit 280, then valve 284 is open and valve 288 is closed while valve 274 is closed and valve 278 is open, thereby introducing gas vapor into the tank car 255 through the vent 283 and the conduit 280 and forcing liquid upwardly through the eductor 276 and out of the tank car 255 through the conduit 270. In this manner, a train 50 comprised of interconnected tank cars 255 may be emptied seriatim from either end of the train without moving the tain. Accordingly, it is seen that a train 50 comprised of tank cars 255 may be loaded or unloaded from either end thereof, thereby facilitating faster and more economical use of the train.

While there has been described what is at present considered to be the preferred embodiment of the present invention, it will be understood that various modifications and alterations may be made herein without departing from the true spirit and scope of the present invention, and it is intended to cover in the appended claims all such modifications and alterations as fall within the true spirit and scope of the present invention.

What is claimed is:

1. A railway tank car for interconnection in fluid communication with associated like tank cars by flexible connecting conduits for accommodating consecutive loading, unloading, and transportation of expandable ladings, said tank car comprising a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having an outer end in fluid communication with said lading conduit means and having an inner end in fluid communication with the interior of said tank, the inner end of said eduction conduit being positioned near the bottom of said tank to facilitate the emptying of said tank through said eduction conduit, a vent conduit having an outer end in fluid communication with said lading conduit means and having an inner end in fluid communication with the interior of said tank, a baffle positioned between said ends of said lading conduit means inside said tank and forming a fluid tight seal with the top thereof, said baffle extending a predetermined distance into said tank and terminating at a horizontal lower end disposed below said inner end of said vent conduit, filling of said tank through said eduction conduit with lading to a level above said lower end of said baffle causing compression of gas trapped above said lading to a pressure at which occurs outflow of lading through said vent conduit at the same rate as the inflow of lading through said eduction conduit thereby to provide in said tank above the lading a free vapor space, and conduit coupling means on each of said outer ends of said lading conduit means for coupling to an adjacent end of an associated flexible connecting conduit to place said tank in fluid communication with the tanks of adjacent like tank cars, whereby said tank may be connected by associated flexible connecting conduits to associated like tanks in a series through which expandable liquid lading may flow to accommodate consecutive loading to a predetermined level, transporting thereof while automatically providing a free vapor space at the top of said tank above the liquid lading, and substantially complete unloading thereof through said eduction conduit.

2. The railway tank car set forth in claim 1, wherein the inner end of said vent conduit is flush with the tank shell.

3. The railway tank car set forth in claim 1, wherein said baffle is adjacent to said vent conduit.

4. The railway tank car set forth in claim 1, wherein the bottom edge of said baffle is normal to the longitudinal axis of said tank car.

5. A railway tank car for interconnection in fluid communication with associated like tank cars by flexible connecting conduits for accommodating consecutive loading, unloading, and transportation of expandable ladings, said tank car comprising a wheeled chassis structure provided with chassis coupling means for coupling to the chassis of associated cars, a tank mounted on said chassis structure, lading conduit means mounted on the top of said tank and having two outer ends respectively extending outwardly from said tank adjacent to the opposite ends of the top thereof, two eduction conduits each having an outer end in fluid communication with said lading conduit means and having an inner end in fluid communication with the interior of said tank, each of said eduction conduits extending downwardly in said tank and having an inner end thereof positioned near the bottom of said tank to facilitate the emptying of said tank through either of said eduction conduits, two vent conduits each having an outer end in fluid communication with said lading conduit means and having an inner end in fluid communication with the interior of said tank, a plurality of valves for interrupting communication between said vent conduits and said lading conduit means and between said eduction conduits and said lading conduit means, a baffle positioned between said outer ends of said lading conduit means inside said tank and forming a fluid tight seal with the top thereof, said baffle extending a predetermined distance into said tank and terminating at a horizontal lower end disposed below said inner ends of said vent conduits, whereby said tank may be loaded and unloaded from either end of said lading conduit means by adjustment of said valves to interrupt communication between the one end of said loading conduit means and the adjacent vent conduit and to interrupt communication between the other end of said lading conduit means and the adjacent eduction conduit.

6. The railway tank car set forth in claim 5, wherein each of the vent conduits is disposed between the associated eduction conduit and the adjacent end of said tank.

7. The railway tank car set forth in claim 5, wherein the bottom edge of said baffle is normal to the longitudinal axis of said tank car.

8. The railway tank car set forth in claim 5, and including two baffles respectively positioned adjacent to and inboard of said eduction conduits.

9. The railway tank car set forth in claim 5, wherein a valve is positioned in each of said eduction conduits and each of said vent conduits to interrupt communication between said lading conduit means and said eduction conduits and between said lading conduit means and said vent conduits.

10. A railway train of tank cars for accommodating consecutive loading, unloading and transportation of expandable ladings, said train comprising a plurality of railway tank cars connected in tandem relationship, each of said tank cars including a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having an outer end in fluid communication with said lading conduit means and having an inner end in fluid communication with the interior of said tank, the inner end of said eduction conduit being positioned near the bottom of said tank to facilitate the emptying of said tank through said eduction conduit, a vent conduit having an outer end in fluid communication with said lading conduit means and having an inner end in fluid communication with the interior of said tank, and a baffle positioned between said ends of said lading conduit means inside said tank and forming a fluid tight seal with the top thereof, said baffle extending a predetermined distance into said tank and terminating at a horizontal lower end disposed below said inner end of said vent conduit, filling of said tank through said eduction conduit with lading to a level above said lower end of said baffle causing compression of gas trapped above said lading to a pressure at which occurs outflow of lading through said vent conduit at the same rate as the inflow of lading through said eduction conduit thereby to provide in said tank above the lading a free vapor space, and conduit coupling means on each of said outer ends of said lading conduit means for coupling to an adjacent end of an associated flexible connecting conduit to place said tank in fluid communication with the tanks of adjacent like tank cars, whereby said train is formed of tanks connected by associated flexible connecting conduits in a series through which expandable liquid lading may flow to accommodate consecutive loading to a predetermined level, transporting thereof while automatically providing a free vapor space at the top of said tanks above the liquid lading, and substantially complete unloading thereof through said eduction conduits.

11. A railway train of tank cars for accommodating consecutive loading, unloading and transportation of expandable ladings, said train comprising a plurality of railway tank cars connected in tandem relationship, each of said tank cars including a wheeled chassis structure provided with chassis coupling means for coupling to the chassis of associated cars, a tank mounted on said chassis structure, lading conduit means mounted on the top of said tank and having two outer ends respectively extending outwardly from said tank adjacent to the opposite ends of the top thereof, two eduction conduits each having an outer end in fluid communication with said lading conduit means and having an inner end in fluid communication with the interior of said tank, each of said eduction conduits extending downwardly in said tank and having an inner end thereof positioned near the bottom of said tank to facilitate the emptying of said tank through either of said eduction conduits, two vent conduits each having an outer end in fluid communication with said lading conduit means and having an inner end in fluid communication with the interior of said tank, a plurality of valves for interrupting communication between said vent conduits and said lading conduit means and between said eduction conduits and said lading conduit means, a baffle positioned between said outer ends of said lading conduit means inside said tank and forming a fluid tight seal with the top thereof, said baffle extending a predetermined distance into said tank and terminating at a horizontal lower end disposed below said inner ends of said vent conduits, whereby said train may be loaded and unloaded from either end thereof by adjustment of said valve on each of said tank cars to interrupt communication between the individual ends of said lading conduit means and adjacent vent conduits and to interrupt communication between the other ends of the lading conduit means and the adjacent eduction conduits.

* * * * *

UNITED STATES PATENT AND TRADEMARK OFFICE

CERTIFICATE OF CORRECTION

PATENT NO. : 4,079,760

DATED : March 21, 1978

INVENTOR(S) : Doug Hurst

It is certified that error appears in the above-identified patent and that said Letters Patent are hereby corrected as shown below:

Column 2, line 65, "termination" should be --terminating--.

Column 5, equation 4, "$P_A$ = Patm + h(130B) + $\Delta P_A$" should be --$P_A$ = Patm + h(130B) + $\Delta P_C$ + $\Delta P_A$--;

line 51, "reperesented" should be --represented--.

Column 8, line 42, "tain" should be --train--.

Column 10, line 4, "loading" should be --lading--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*